United States Patent [19]

Russell, Jr.

[11] 4,225,660

[45] Sep. 30, 1980

[54] TREATED TONER CARRIER AND METHOD OF MAKING THE SAME

[75] Inventor: John J. Russell, Jr., Woodbury, Conn.

[73] Assignee: Pitney Bowes Inc., Stamford, Conn.

[21] Appl. No.: 1,650

[22] Filed: Jan. 8, 1979

[51] Int. Cl.[3] ..... G03G 9/14

[52] U.S. Cl. ..... 430/108; 427/127; 427/216; 427/221; 427/340; 428/407

[58] Field of Search ..... 427/127, 221, 340; 252/62.1 P; 428/407; 430/108

[56] References Cited

U.S. PATENT DOCUMENTS

| | | | |
|---|---|---|---|
| 3,533,835 | 10/1970 | Hagenbach et al. . | |
| 3,736,257 | 5/1973 | Miller . | |
| 3,778,262 | 12/1973 | Queener et al. | 252/62.1 P |
| 3,922,381 | 11/1975 | Datta . | |
| 3,989,648 | 11/1976 | Lenhard et al. . | |
| 4,068,017 | 1/1978 | Westdale | 252/62.1 P |
| 4,071,655 | 1/1978 | Brana et al. | 252/62.1 P |
| 4,094,803 | 6/1978 | Gibson et al. | 252/62.1 P |
| 4,113,641 | 9/1978 | Brana et al. | 252/62.1 P |

OTHER PUBLICATIONS

Beatty et al., "Carrier Coating Modifications", Xerox Disclosure Journal, vol. 3, No. 3, May/Jun. 1978, p. 197.

Smith, "Covalent Crosslinking of Carrier Coatings for Increased Developer Life", Xerox Disclosure Journal, 2, No. 6, 11/12/77.

Creatura, "Dye Coated Carrier Material", Xerox Disclosure Journal, vol. 2, No. 6, 11/12/77.

Adams et al., "Modified Polystyrene for Electrophotography", IBM Tech. Dis. Bull., vol. 19, No. 3, 8 (1926).

*Primary Examiner*—John D. Smith

*Attorney, Agent, or Firm*—Melvin J. Scolnick; Wiliam D. Soltow, Jr.; Albert W. Scribner

[57] ABSTRACT

Method and means is disclosed for treating carrier particles in order to change the charge to mass ratio and the resistivity of a development powder encompassing such particles. The carrier particles are first coated with a polymer capable of providing reactive sites and then an additional treatment is carried out with a material that will react to the reactive sites. Another advantage of the treatment is that the carrier particles are protected from oxidation following such treatment.

5 Claims, No Drawings

TREATED TONER CARRIER AND METHOD OF MAKING THE SAME

BACKGROUND OF THE INVENTION

With the increased use of plain paper copiers, development powders have enjoyed an increased popularity over liquid toners. Along with the increased use of development powders, magnetic brush units are becoming increasingly popular. Development powders used with magnetic brush units usually have an iron powder which serves as the carrier particle material to which toner is electrostatically attached.

While ordinarily capable of producing good quality images, conventional development powders suffer serious deficiencies in certain areas. In the reproduction of high contrast copies such as letters, tracings and the like, it is desirable to select the toner and carrier particles so that their mutual electrification is relatively large, the degree of such electrification being governed in most cases by the distance between their relative positions in the triboelectric series. However, when otherwise compatible electroscopic powder and carrier materials are removed from each other in the triboelectric serious by too great a distance, the resulting images are very faint because the attractive forces between the toner and carrier particles compete with attractive forces between the toner particles and the latent electrostatic image. Although such image density may be improved by increasing the toner concentration in the development powder, undesirably high background toner deposition as well as increased toner impaction and agglomeration is encountered when the development powder is overtoned. In some systems the initial electrostatographic photoconductor charge may be increased to improve the density of the deposited powder image, but this would have to be excessively high in order to attract the electroscopic powder away from the carrier particles. It is therefore apparent that many materials which otherwise have suitable properties for employment as carrier particles or toners are unsuitable because they possess too high a triboelectric value.

Although it may be possible to alter the triboelectric value of a carrier by blending one carrier material with another carrier material having a triboelectric value remote from the triboelectric value of the original carrier material, relatively larger quantities of additional material is necessary to alter the triboelectric value of such original carrier material. The addition of large quantities of material to the original carrier material to change the triboelectric properties thereof requires a major manufacturing operation and often undersirably alters the original physical characteristics of the carrier material. Further, it is highly desirable to control the triboelectric properties of carrier surfaces to accomodate the use of desirable toner compositions while retaining the other desirable physical characteristics of the carrier material. The alteration of the triboelectric properties by treating the surface is a desirable technique, as taught in U.S. Pat. Nos. 3,922,381 and 3,989,648. This enables one to attain the desired triboelectric properties of the carrier surface through the adhesion and/or adsorption of selected material but is limited to use where the other desired physical properties are extant.

Additionally, in magnetic-brush development of electrostatic images, for a given developer-hardware system, the carrier particles are required to have some specific system related electrical resistance to produce good quality solid area development. Some systems require a low resistivity, and to achieve this electro or electroless plating has been required as described in U.S. Pat. No. 3,736,257. Others have required the dispersion of conductive materials such as carbon black, inorganic salts, and the like as described in U.S. Pat. No. 3,533,835.

The alteration of the resistivity of a carrier particles by applying a surface coating thereon is a particularly desirable technique. Thus, for example, a carrier having the desired physical properties with the exception of electrical resistivity, can be coated with a material having the desired degree of electrical resistivity as well as other physical properties, rendering the resultant product more useful as a carrier. In order to attain the right triboelectric relationships with the desired toner, a charge-directing agent is used to enhance this characteristic. While a carrier prepared with a polymer-charge directing agent blend has utility, it also has disadvantages. Batch to batch uniformity is poor, triboelectric properities may change with time. The origin of these difficulties probably lies in the incomplete compatability of the charge-directing agent with the polymer and possibly due to the leaching of the agent from the carrier coating.

The foregoing discussion demonstrates that there is need for better electrostatographic carriers, and an improved method for making the same. From the above discussion it can be seen that it is necessary to select a carrier with proper triboelectrification for suitable toners and that electrical resistivity is an important parameter.

The coated carrier particle should also have a coating that resists impaction of the toner, resists abrasion, has good adhesion to the core material and has good flow properties. Many coating materials can be found to have some of the desired properties, no material has them all. Many polymeric materials could be synthesized but have little utility due to solubility in high boiling solvents, making coating difficult and/or costly, poor film forming properties, and high melting points making it difficut to coat via melt techniques.

It is believed that the instant invention permits greater flexibility in the design of carrier materials by ignoring triboelectric properties during the coating process, then modifying the surface of the coated particle via chemical reaction.

SUMMARY OF THE INVENTION

It has been found that that the charge to mass ratio and resistivity of a development powder may be controlled if the carrier particle is initially covered with a first polymeric coating, or intermediate layer, which provides reactive sites and subsequently treated with a material that reacts with such reactive sites. Carrier particles which have been coated with such a polymer, treated in accordance with the instant invention and subsequently used in a development powder bring about high image density and a low background. One also obtains good stability to rusting under high relative humidity, a constant triboelectric charge property under all conditions when mixed with standard toners and low dusting of the toner in a magnetic brush unit. The latter allows the use of lower biased voltage during development which improves the reliability of machine performance.

DESCRIPTION OF THE PREFERRED EMBODIMENT

The material of the carrier particle included in the present invention may be any magnetic material which can serve as a carrier particle such as iron and magnetite. The size of the core may be between 40 and 1000 microns with the preferred size range being between 50 and 400 microns.

The carrier particles are initially coated with a polymer capable of providing reactive sites, such polymers being well known, examples of which are epoxy resin, copolymer of styrene and methylvinyl ether or maleic anhydride and a copolymer of methyl ether and maleic anhydride. As used herein reactive sites is defined as functional organic chemical groupings distributed along the polymeric chain such that sites are created were covalent bonding may take place. The initial coating may be accomplished by forming a solution containing the polymer, dispersing the carrier particles into the solution, then drying the covered particles to form the coating.

After the carrier particles are coated, they are treated with an appropriate reagent capable of reacting with the reactive sites created by the polymer. Such reagents may be in the form of a vapor, solution or solid. when solutions are used, they may use either a solvent or a non-solvent for the polymer coating, the non-solvent being the preferred material capable of reacting with the sites provided by the polymer.

One preferred reagent is a perfluoro compound. The perfluoro compound may be selected from a number of classes including perfluoro alcohols, perfluoro amines and perfluoro acids. These materials have useful properties for electroscopic developers such as requisite triboelectric characteristics, toughness and abrasiveness. Additional materials which may be used as reagents include Rhodamine B, basic fuschine, stearic acid, stearyl amine and tetrachlorophthalic anhydride.

EXAMPLE I

A quantity of 200 gm. of iron powder having a density of 2.95 gm/cm$^3$ and particle size of approximately 50-250 was coated with 5.33 g of a 37.4% solution of a low molecular weight 1:1 copolymer of methylvinyl ether and meleic anhydride dissolved in methylethylketone. The iron polymer solvent mixture was stirred at room temperature until the solvent evaporated and the powder was dry and free flowing.

50 mls of crude 11-H eicosafluoroundecanol was heated to 75 degrees centigrade and added to the dry free flowing iron powder. Stirring was continued for 10 minutes. The coated iron/fluor-alcohol mass was then washed four times with 50 mls aliguots of methanol then dried in an oven at 100 degrees centigrade for 30 minutes A developer was prepared using 97.6 g of the coated iron and 2.4 g of an epoxy base resin modified with polyvinyltoluene and containing carbon black and nigrosine for coloring. The charge to mass ratio of this developer was determined to be 4.2 $\mu$C/g/

The above iron powder and toner was used in all subsequently described Examples and their properties and composition will not be repeated.

EXAMPLE II

Five grams of 1:1 copolymer of styrene-maleic anhydride was dissolved in 50 g. of tetrahydrofuran. This solution was then added to 500 g iron powder and stirred at room temperature until the solvent evaporated leaving a dry, free flowing powder.

To 100 grams. of the above free flowing powder was added 50 grams of hot, crude 11-H eicosafluoroundecanol. The powdered iron/fluoro-alcohol was maintained on a hot plate for 20 minutes. The excess 11-H eicosafluoroundecanol was decanted, the mixture cooled and washed six times with isopropanol and dried at 75 degrees centigrade for one hour. The powder was then washed four times with a fluorinated hydrocarbon and dried 20 minutes at 75 degrees centrigrade.

To 97.6 g of the resulting product was added 2.4 g of toner. The charge to mass ratio of the resulting electroscopic developer was determined to be 15.3 $\mu$C/g.

EXAMPLE III

To 500 g iron, 50 grams of a 10% water solution of polyvinyl alcohol was added. The mass was continually stirred and heated until the water evaporated leaving a dry, free flowing powder.

To 97.6 g of the coated iron powder was added 2.4 g toner. The charge to mass of the resulting developer was determined to be 11.5 $\mu$C/g.

EXAMPLE IV

Two hundred grams of the polyvinyl alcohol treated iron powder product of Example III was added through stirring to 50 mls of a mixture of a fluorinated hydrocarbon (trichlorotrifluoroethane) and 11.1% acetone in which 0.3 g of 11-H ercosa-fluoroundecanoic acid was dissolved. Approximately 10 mls of the mixture was then removed by decantation, and the rest removed by evaporation at 75 degrees centigrade for 30 minutes.

To 97.6 grams of the product was added 2.4 grams of toner. The resultant developer was found to have a charge to mass ratio of 25.3 $\mu$C/g.

The following are Examples, by which the triboelectric characteristics are modified by post treatment and/or reaction.

EXAMPLE V

To 100 grams of the iron treated with polyvinyl alcohol as described in Example III, 20 grams of a saturated solution of Rhodamine B in isopropanol was added.

The Rhodamine B has a reactive carboxyl group, and polyvinyl-alcohol is insoluble in isopropanol. The iron was stirred until the alcohol evaporated leaving a dry, free flowing powder with a reddish cast.

To 97.6 g of this powder was added 2.4 g of toner. The charge to mass ratio of this developer is found to be 7.5 $\mu$C/g.

EXAMPLE VI

To 100 grams of the polymer and perfluoro coated powder described in Example II above was added 20 mls of the mixture of fluoroinated hydrocarbon and acetone to which a 5 mls saturated solution of basic Fuschin in isopropanol was added. The product was dried in an oven at 75 degrees centigrade until the solvent had evaporated leaving a dry, free flowing powder. Basic Fuschin has reactive amino groups, and the styrene-maleic anhydride copolymer is insoluble in the fluorinated hydrocarbon-acetone mixture. The dry powder has a purple color.

To 97.6 g of this dry powder was added 2.4 g toner. The resultant developer has a charge to mass ratio of 25.4 $\mu$C/g.

EXAMPLE VII

A quantity of iron was treated with an epoxy resin which had been diluted with tetrahydrafuran to obtain a 3–5% solution. The iron was added to the polymeric solution and dried. The resulting coated iron had one percent weight of coating. A portion of the coated iron was blended with toner. Other portions of the coated iron powder were treated with Rhodamine B, basic fuschine, stearic acid, stearyl amin and tetrachloro phthalic anhydride, respectively, before being blended with the toner. The following C/M values were obtained:

| Development Powder | Charge to Mass |
|---|---|
| Untreated coated carrier particle | 5.8 |
| Rhodamine B | 1.7 |
| Basic Fuschine | 3.4 |
| Stearic Acid | 13.2 |
| Stearyl Amine | 9.5 |
| Tetrachlorophthalic Anhydride | 6.7 |

Example VIII

One thousand grams of the polyvinyl alcohol treated iron powder product which was prepared in the same manner as described in Example III was added through stirring to 250 mls of a mixture of a fluorinated hydrocarbon (trichlorofluoroethane) and 11.1% acetone in which 1.5 g of 11-H eicosa-fluoroundecanoic acid was dissolved. Approximately 50 mls of the mixture was then removed by decantation, and the rest removed by evaporation at 75 degrees centigrade for 30 minutes.

To 976 grams of the product was added 24 grams of toner. The resultant developer was found to have a charge to mass ratio of 25.3$\mu$C/g.

This material was placed in the developer housing of a copier of the type described in U.S. Ser. No. 670,253 filed Mar. 25, 1976 and now U.S. Pat. No. 4,084,901 issued Apr. 18, 1978. Copies were produced at optimum exposure at various development bias voltages.

Good quality copies with a minimum of background were produced at voltages in excess of 100 volts, the maximum being 175 volts. These results show that the resistivity, as well as the charge to mass ratio, was matched to the copier environment.

As can be seen from the above Examples, the charge per mass may be varied by proper selection of the reagent. This becomes important in matching the toner and the carrier particles. Each toner selected would have a different C/M when combined with the carrier particle as is well known in the art. If the C/M is too high, satisfactory image density may not be obtainable because the toner may not be separated by the charged image in specific copier environments. Consequently in this particular situation it would be desirable to reduce the C/M treating the polymeric coated carrier particle with a selected reagent. As was shown in Example VIII, the same was accomplished with regard to matching resistivity. The resistivities of the various development powders produced in the above Examples were not measured because such measurement is difficult and expensive to achieve. Based upon the results achieved in Example VIII it is apparent that the resistivity of the development powder can be matched to its environment by proper selection of materials in accordance with the teachings hereof.

What is claimed is:

1. A particulate magnetic carrier for use in a development powder, the particle being coated with a polymer capable of providing reactive sites of functional organic chemical groupings distributed along the polymeric chain and having on the outer surface of said coating a perfluoro compound selected from the group consisting of perfluoro alcohols, perfluoro amines, and perfluoro acids covalently reacted with said sites.

2. The carrier particle of claim 1 where said particle is iron.

3. The carrier particle of claim 1 wherein said polymeric material is selected from the group of epoxy resin, and copolymers of styrene methylvinyl ether, styrene malecic anhydride and methylvinyl ether-maleic anhydride.

4. In a method for controlling the charge to mass ratio and resistivity of a carrier particle to be used in a development powder, the steps comprising:

a. applying to the surface of a magnetic carrier particle a polymeric coating capable of creating reactive sites of functional organic groupings along the polymeric chain; and b. treating the coated magnetic carrier particle with a perfluoro compound selected from the group consisting of perfluoro alcohols, perfluoro amines and perfluoro acids capable of reacting with said sites to form covalent bonds at the sites.

5. The method of claim 4 wherein said carrier particle is iron.

* * * * *

UNITED STATES PATENT AND TRADEMARK OFFICE

CERTIFICATE OF CORRECTION

PATENT NO. : 4,225,660

DATED : September 30, 1980

INVENTOR(S) : John J. Russell, Jr.

It is certified that error appears in the above—identified patent and that said Letters Patent is hereby corrected as shown below:

Column 1, line 25, change "serious" to -- series --.
Column 1, line 52, change "undersirably" to -- undesirably --.
Column 1, line 55, change "accomodate" to -- accommodate --.
Column 2, line 9, change "particles" to -- particle --.
Column 2, line 44, change "difficut" to -- difficult --.
Column 2, line 52, delete second occurrence of "that".
Column 3, line 17, change "were" to -- where --.
Column 3, line 56, insert a period -- . -- at end of sentence.
Column 3, line 61, after "g", delete "/" and insert a period.
Column 4, line 4, delete period after "grams".
Column 4, line 12, change "Centrigrade" to -- centigrade --.
Column 4, line 31, change "ercosa-fluorondecanoic" to -- eicosa-fluorondecanoic --.
Column 4, line 57, change "fluoroinated" to -- fluorinated --.
Column 5, line 10, change "amin" to -- amine --.
Column 6, line 33, change "malecic" to -- maleic --.

Signed and Sealed this

*Third* Day of *November 1981*

[SEAL]

*Attest:*

GERALD J. MOSSINGHOFF

*Attesting Officer*

*Commissioner of Patents and Trademarks*